US006742454B2

(12) United States Patent
Murray

(10) Patent No.: US 6,742,454 B2
(45) Date of Patent: Jun. 1, 2004

(54) METHOD FOR MODIFYING AN IMAGE SURFACE OF A PRINTING PLATE

(75) Inventor: Robert Richard Murray, Madbury, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/011,929

(22) Filed: Oct. 30, 2001

(65) Prior Publication Data

US 2003/0079635 A1 May 1, 2003

(51) Int. Cl.[7] ..... B41C 1/055; B41C 1/10

(52) U.S. Cl. ..... 101/401.1; 101/467; 101/478; 101/484

(58) Field of Search ..... 101/456, 457, 101/463.1, 465, 466, 467, 478, 395, 401.1, 484; 430/302

(56) References Cited

U.S. PATENT DOCUMENTS

| | | | | | |
|---|---|---|---|---|---|
| 3,654,864 | A | * | 4/1972 | Ovshinsky | 101/467 |
| 3,678,852 | A | * | 7/1972 | Feinleib et al. | 101/465 |
| 4,148,057 | A | * | 4/1979 | Jesse | 101/456 |
| 4,500,587 | A | * | 2/1985 | Kamaishi et al. | 101/457 |
| 4,718,340 | A | * | 1/1988 | Love, III | 101/116 |
| 5,033,378 | A | * | 7/1991 | Ebihara | 101/152 |
| 5,145,758 | A | * | 9/1992 | Kossmehl et al. | 430/49 |
| 5,158,017 | A | * | 10/1992 | MacConnell et al. | 101/148 |
| 5,191,834 | A | * | 3/1993 | Fuhrmann et al. | 101/130 |
| 5,816,164 | A | * | 10/1998 | Loffler | 101/484 |
| 6,024,020 | A | * | 2/2000 | Romano et al. | 101/484 |
| 6,303,271 | B1 | * | 10/2001 | Bennett et al. | 101/465 |
| 6,449,385 | B1 | * | 9/2002 | Huber et al. | 101/484 |

FOREIGN PATENT DOCUMENTS

| | | | |
|---|---|---|---|
| CA | 2195826 | * | 7/1997 |
| GB | 2284684 | | 6/1995 |
| WO | 97/49557 | * | 12/1997 |

* cited by examiner

*Primary Examiner*—Stephen R. Funk
(74) *Attorney, Agent, or Firm*—Davidson, Davidson & Kappel, LLC

(57) ABSTRACT

A method for modifying an image surface of a printing plate includes identifying a location of a pixel of an image at the image surface, an ink being disposed at the location of the pixel. The ink at the location of the pixel is then irradiated using a laser imaging system. The ink may be cured by the radiation so that it is hardened and useable to receive liquid ink and be used as a printing surface. The ink may be ablated and removed. Individual pixels of the image may be added or removed from the printing surface.

19 Claims, 2 Drawing Sheets

METHOD FOR MODIFYING AN IMAGE SURFACE OF A PRINTING PLATE

BACKGROUND

The present invention relates generally to printing plates for lithographic printing presses, and particularly to a method for modifying an image surface of a printing plate.

In lithographic offset printing press technology, ink is applied to an image surface of a printing plate. The image surface includes ink-loving and water-loving areas. Water adheres to the water-loving areas. The ink adheres to the ink-loving areas and is repelled from the water-loving areas. The ink which adheres to the ink-loving areas is transferred to a blanket and then to a sheet, web, etc., of paper or other material to produce the printed image.

Relatively complex processes are used to produce an image surface on a printing plate, i.e., to "image" the plate. In the typical lithographic process, light, as from a laser or multiple lasers, is directed onto a light-sensitive substance on the surface of the printing plate. A laser imaging system is employed to scan the printing plate with the laser(s) so as to expose areas the light-sensitive substance in the pattern of a desired motif British Patent Document No. GB 2 284 684 describes a method of imaging a photosentsitive printing form using a coating sensitive to UV light using a mercury lamp and a system of mirrors and lenses.

According to one method for producing the image surface, the light-sensitive substance is a monomer which becomes polymerized upon exposure to light of the proper frequency, intensity and duration. Polymerization of the exposed areas occurs during the scanning process, so as to produce hardened ink-loving areas. The monomer at non-exposed areas is then washed away, leaving water-loving areas.

A problem with prior methods for producing an image surface is that most provide a relatively short plate life, i.e., a portion or all of the image surface wears out relatively quickly. There is no way for restoring even portions of the image surface without repeating the entire imaging process. Another problem with prior methods is that most provide a limited, if any, ability to correct small problems—i.e., to remove or add an ink-loving layer to small and/or defined areas, for example to remove built-up ink and/or foreign matter from water-loving or ink-loving areas. It is known to use "erase/write" pens to manually correct dots, but this is difficult and only relatively large areas made up of multiple pixels may be corrected. As a result erase/write pens are not often used. Instead, entire plates are re-imaged to correct even small problems.

SUMMARY OF THE INVENTION

The present invention provides a method for modifying a surface of a printing plate. The method includes identifying a location of a pixel of an image at the surface, an ink being disposed at the location of the pixel; and irradiating the ink at the location of the pixel using a laser imaging system.

Identifying the location of the pixel may be performed using an optical analysis system on a printed product of the printing plate. Moreover, identifying the location of the pixel may be performed using the laser imaging system.

The laser imaging system may be an on-press laser imaging system useable to establish the image.

Irradiating the ink may be performed so as to harden the ink.

The method according to the present invention may further include adding a hardening agent to the ink prior to the irradiating, the hardening agent being curable by a frequency of an electromagnetic radiation emitted by the laser imaging system.

Irradiating the ink may be performed so as to harden the ink and produce a hardened ink surface useable for printing. The hardened ink surface may be capable of receiving additional ink for performing the printing.

The method according to the present invention may further include disposing additional ink at the location after at least one print run, and irradiating the additional ink so as to harden the additional ink and establish a renewed hardened ink surface useable for printing.

The ink may be disposed on a primary image surface of the image. The primary image surface may include a polymer substance.

The ink may be disposed on a printing substrate of the printing plate.

In an embodiment of the present invention, the ink may be hardened ink and irradiating the ink may be performed so as to loosen at least a portion of the ink. Irradiating the ink may be performed so as to ablate at least a portion of the ink.

The method according to the present invention may further include treating the ink with a fountain solution so as to remove at least a first portion of the ink.

The ink may be erroneously disposed at the location of the pixel.

The irradiating may be performed as part of a removal operation of at least a portion of the ink and the method according to the present invention may further include disposing an additional ink at the location of the pixel, and irradiating the additional ink at the location of the pixel using the laser imaging system so as to harden the additional ink.

The irradiating may be performed as part of a removal operation of at least a portion of the ink and the method according to the present invention may further include identifying a location of a second pixel of the image at the printing surface, disposing an additional ink at the location of the second pixel, and irradiating the additional ink at the location of the second pixel using the laser imaging system so as to harden the additional ink.

The irradiating may be performed with the printing plate disposed on a plate cylinder of a printing press.

The present invention also provides an image surface for a printing plate. The image surface includes a hardened ink layer at a location of a pixel of an image, the hardened ink layer being formed by an irradiation using a laser imaging system and being useable as a printing surface.

The present invention provides a renewable high-wear surface of hardened ink and a way of correcting errors by adding or removing a pixel. An on-press laser imaging system may be advantageously be used in performing the method according to the present invention.

BRIEF DESCRIPTION OF THE DRAWINGS

The present invention is elaborated upon below with reference to the accompanying drawings.

DETAILED DESCRIPTION

Figure 1:
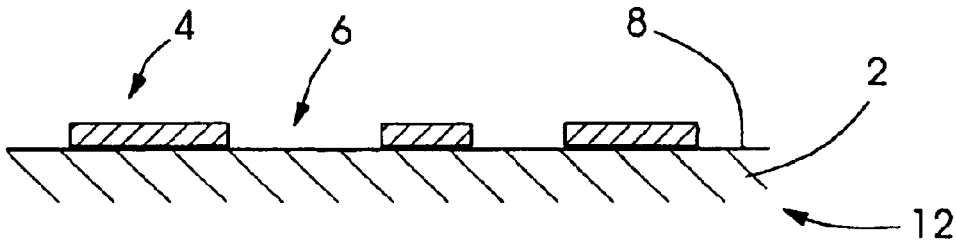
FIG. 1 shows a side cross-sectional view of an printing plate image surface printing plate according to an embodiment of the present invention.

Referring to FIG. 1, a side cross-sectional view of a printing plate image surface 8 according to an embodiment of the present invention is shown. Image surface 8 includes ink-loving areas 4 and ink-rejecting areas 6 formed on printing substrate 2 of printing plate 12. Printing substrate 2 may be anodized aluminum or any suitable material. Ink-loving areas 4 include hardened ink, and may additionally include curing agents, such as ultraviolet (UV)-curing monomers or infrared (IR)-curing monomers, for example. Ink-rejecting areas 6 may be water-coated or fountain solution-coated portions of the surface of printing substrate 2. In other embodiments of the present invention, ink-rejecting areas may include silicone. In some embodiments of the present invention, ink-rejecting areas may be the uncoated surface of printing substrate 2.

The hardened ink in ink-loving areas 4 may be formed by irradiating printing ink using an appropriate laser dose schedule. Defining and performing such an appropriate laser dose schedule would be within the capability of those of skill in the art. An on-press laser imaging system may be used to carry out the laser dose schedule.

An image may include dark, or printing, areas and blank, or non-printing, areas. Ink-loving areas 4 form printing areas of an image, while ink-rejecting areas 6 form non-printing areas of the image. Ink-loving areas 4 may form an entire printing portion of an image. Alternatively, ink-loving areas 4 may form sub-areas of a printing portion of an image, or one or more defined "dots." In other embodiments of the present invention, an ink-loving area 4 may form one pixel of an image.

In an embodiment of the present invention, image surface 8 may be formed by applying ink to printing substrate 2 and imaging the ink using a laser imaging system so as to irradiate areas of the ink. Any suitable imaging method may be used, the details of which would be known to those of skill in the art. An appropriate dose schedule is carried out so as to cure/harden the ink and form ink-loving areas 4. Defining and performing such an appropriate laser dose schedule would be within the capability of those of skill in the art. Curing agents may be added to the ink before applying the ink to printing substrate 2. Unirradiated ink may be removed from using fountain solution, with or without an intervening inkless print run to aid in the removal process, so as to form ink-rejecting, or water accepting, areas 6. The resulting image surface 8 may be inked and used as a primary printing surface.

Printing plate 12 may be disposed on a plate cylinder of a printing press (not shown). Alternatively, printing plate 12 may itself form the surface of a plate cylinder of a printing press. Printing plate image surface 8 may be used for printing a web, sheet, etc., of paper, material, etc., by inking printing plate 12 in the customary fashion. Printing ink may thereby be disposed on ink-loving areas 4. The ink may then be transferred to a blanket, for example, in an offset printing process. Alternatively, the ink on printing plate 12 may be directly transferred to a printed medium in a direct printing process. The hardened ink of ink-loving areas 4 may thereby serve as a wear-resistant primary image surface plate surface.

Figure 2:
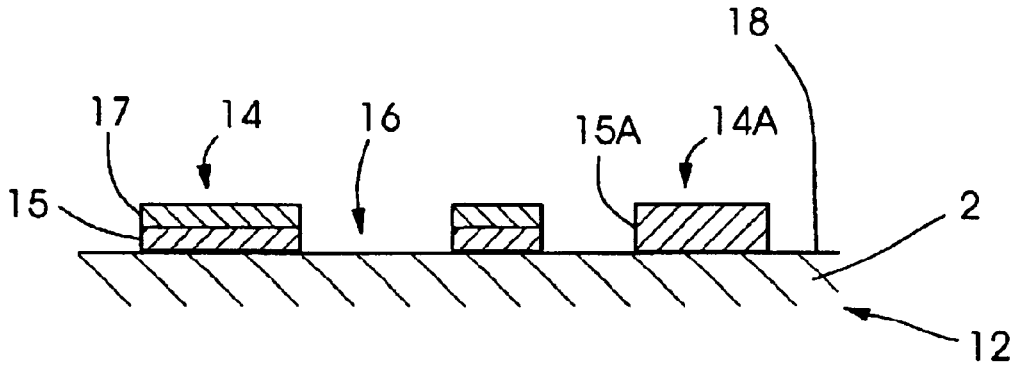
FIG. 2 shows a side cross-sectional view of a printing plate image surface according to another embodiment of the present invention.

Referring to FIG. 2, a side cross-sectional view of a printing plate image surface 18 printing plate according to another embodiment of the present invention is shown. Image surface 18 includes ink-loving areas 14 and ink-rejecting, or water-accepting, areas 16 formed on printing substrate 2 of printing plate 12. Printing plate 12 maybe disposed on a plate cylinder of a printing press (not shown). Printing substrate 2 may be anodized aluminum or any suitable substance. Ink-loving areas 14 include hardened ink layers 17 disposed on primary image layers 15. Primary image layers 15 may include a polymer or other material useable as a printing surface. Hardened ink layers 17 may include hardened ink and may additionally include curing agents, such as ultraviolet (UV)-curing monomers or infrared (TR)-curing monomers, for example. Ink-rejecting areas 16 may be the uncoated surface of printing substrate 2. In other embodiments of the present invention, ink-rejecting areas may include silicone.

Ink-loving areas 14 form dark, or printing, areas of an image, while ink-rejecting areas 16 form blank, or non-printing, areas of the printing image. Ink-loving areas 14 may form an entire printing portion of an image. Alternatively, ink-loving areas 14 may form sub-areas of a printing portion of an image, or one or more defined "dots." In other embodiments of the present invention, an ink-loving area 14 may form one pixel of an image. In some embodiments of the present invention, a complete image to be printed may include ink-loving areas 14, which include hardened ink layers 17 disposed on primary image layers 15, as well as ink-loving areas 14A, which includes a primary image layer 15A without a hardened ink layer disposed thereon. Primary image layer 15A may include a polymer or other suitable material useable as a printing surface.

In an embodiment of the present invention, the primary image layer 15 in each ink-loving area 14 may be formed by imaging printing substrate 2 using a laser imaging system so as to form, for example, a primary image including primary image layers 15 and ink-rejecting areas 16. Any suitable imaging method may be used, the details of which would be known to those of skill in the art. Then, to form hardened ink layer 17 on each primary image layer 15, printing ink may be applied to the primary image layers and irradiated. The printing ink may be applied to the primary image layers 15 by inking printing plate 12 in the customary fashion, for example. A desired amount of ink, for example a smaller amount of ink than is customary, may be applied. Alternatively, a customary amount of ink may be applied and a printing cycle performed so as to reduce the amount of ink disposed on primary image layers 15. Once a desired amount of ink is present, then the ink may be irradiated using an appropriate laser dose schedule so as to form hardened ink layers 17. Defining and performing such an appropriate laser dose schedule would be within the capability of those of skill in the art. An on-press laser imaging system may be used to carry out the laser dose schedule. Curing agents, such as light-curing monomers, for increasing the hardness of hardened ink layers 17, may be added to the printing ink before the ink is applied to primary image layers 15.

Printing plate 12 may be disposed on a plate cylinder of a printing press (not shown). Printing plate image surface 18 may be used to print paper, material, etc., by inking printing plate 12 in the customary fashion. Printing ink may thereby be disposed on ink-loving areas 14 and transferred to a blanket, for example, in an offset printing process. The hardened ink of ink-loving areas 4 may thereby serve as a high wear surface. Cohesion of new ink and abrasion of image surface 18 takes place on hardened ink layer 17 rather than on the more sensitive primary image layer 15.

Hardened ink in ink-loving areas 4 or in hardened ink layers 17 of ink-loving areas 14 may be become worn after a number of print cycles. A worn area may have too much ink or foreign matter due to "piling," for example. Alternatively, a worn area may have too little hardened ink due to frictional wearing, for example. Hardened ink may have worn completely away in some areas, so that primary image surface 15 itself it in danger of being, or has already been, worn. According to an embodiment of the present invention, the location of one or more image pixels of ink-loving areas 4 or 14 which have worn to an unacceptable level may be identified and an additional amount of hardened ink added to re-establish the worn areas. The worn pixel(s) may be identified using an optical analysis system on a printed product produced using image surface 8 or 18. In other embodiments of the present invention, visual examination of the printed product may be used. Alternatively, a laser imaging system used to form image surface 8 or 18 may be used to analyze the image surface itself and identify worn pixel(s).

Once worn pixels or areas have been identified, then the laser imaging system may be used to deplete ink from areas having too much ink by directing the laser to each pixel in question and executing a removal schedule so as to remove ink, for example, by ablation using a sufficiently high-energy laser beam. Repeated laser dosed may be used. Fountain solution may also be used to aid in the removal process. Additives, such as coconut oil may be employed. Any suitable removal agent or process may be used alone or in combination to effect the ink removal. A number of print cycles without ink may be performed to remove ablation materials and fluid residues. Hardened ink may be added where necessary by disposing printing ink and curing the ink using the laser imaging system as described above. Also, as described above, hardening agents may be added to increase the hardness of the ink.

Figure 3:
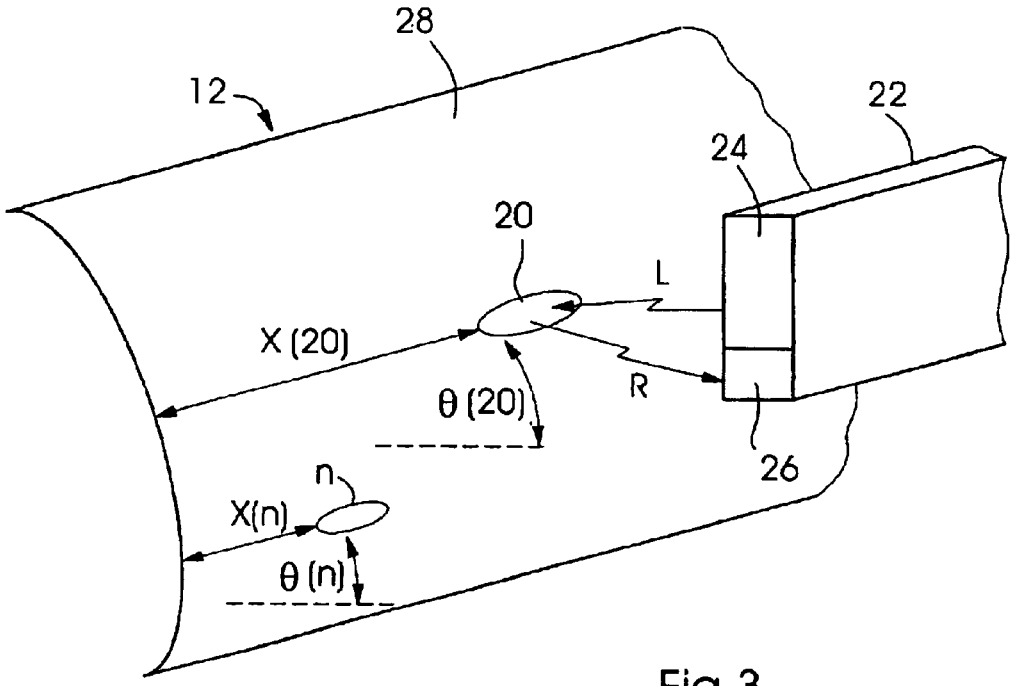
FIG. 3 shows a perspective partial view of an on-press laser imaging system and a printing plate.

FIG. 3 shows a perspective partial view of an on-press laser imaging system 22 and a printing plate 12. Pixel 20 of image surface 28 on printing plate 12 is located at cylindrical coordinates x (20) and θ (20). Laser imaging system 22 includes laser device 24 and read sensor device 26. Laser device 24 irradiates pixel 20 with laser beam L. Read sensor device 26 senses reflected light beam R. Laser imaging system 22 is capable of irradiating and sensing light from pixels located at different cylindrical coordinates x (n), θ (n) for each pixel n of an entire image on printing plate 12. Read sensor device 26 may be used for analyzing pixel 20 so as to evaluate its condition for accepting or rejecting ink or water. Laser device 24 may include an optical system and one or more lasers. When more than one laser is provided, parallel imaging of multiple pixels n may be performed. Likewise, read sensor device 26 may include an optical system and one or more read sensors so that sensing of light from multiple pixels n may be performed in parallel. Laser imaging system 22 may be used to image printing plate 12 in the customary fashion. Laser imaging system 22 may also be used according to the present invention to cure and remove ink as described above. Because laser imaging system 22 may store the location of all pixels in an image, for example in cylindrical coordinate form, the laser imaging system may advantageously be used according to the present invention to cure and remove ink at one or more defined pixels or locations. Where ink to be removed is disposed at one or more pixels or locations erroneously located outside defined printed areas of an image, then the coordinates of the pixel(s) or location(s) may be inputted into laser imaging system 22 in a variety of ways, as would be understood by those of skill in the art.

Figure 4:
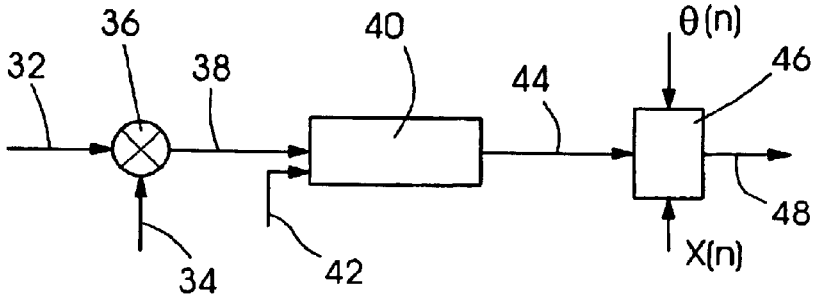
FIG. 4 shows a schematic control diagram for the on-press laser imaging system shown in FIG. 3.

FIG. 4 shows a schematic control diagram for the on-press laser imaging system shown in FIG. 3. Read signal 32 from read sensor device 26 is subtracted from desired value signal 34 in subtractor 36, generating error signal 38. Desired value signal 34 may be generated using a database of stored desired values. Error signal 38, along with acceptable band signal 42, are fed into comparitor 40. Comparitor 40 produces correction command signal 44. Acceptable band signal 42 provides a limit on the magnitude of correction command signal 44. Correction command signal 44 is fed into laser driver 46, which produces driver signal 48. Correction command signal 44 controls laser driver 46 as necessary for adding or subtracting ink from the location of a pixel n. Driver signal 48 is used to control laser device 22 (FIG. 3). Cylindrical coordinates x (n) and θ (n) are fed into driver 46 to provide the location of a pixel n being irradiated.

Various types of laser imaging systems may be used according to the present invention to irradiate ink on an image surface so as to harden or remove the ink as necessary. The imaging laser system may be an on-press or an off-press system. The laser imaging system may include any number of lasers, such as one laser per each pixel of an image. The laser imaging system may emit UV, IR or other frequencies or combinations of frequencies of electromagnetic radiation. The laser imaging system could be employed during print runs of an associated printing press so as to add or remove pixels as printing plate 12 rotates in the printing press.

Using the techniques described above, individual pixels or dots may be added or removed from a printing image formed by image surface 8 or 18. An individual pixel or pixel area, for example including ink and foreign matter, may be located and then removed using a combination of laser ablation and fountain solution, for example. An individual pixel may be added or repaired by depositing and curing ink at the desired location. A primary image may be fine-tuned. For example, hardened ink pixels or dots may be added to problem areas of a primary image otherwise made up of ink-loving areas of a polymeric material. A primary image made up entirely of ink-loving areas of hardened ink without polymeric material may be fine-tuned by removing and/or adding ink and hardening the ink as necessary.

The present invention may also be employed to harden a polymer or ink material placed on a printing plate substrate by an inkjet system. Here, the added material is applied by the ink jet and then cured by the laser. The ink jet can be either the primary system for imaging the plate, or a separate system for correction of missing pixels. Ink or polymer located by any device or method near a desired location may be cured at the exact desired location by the on-press imaging system.

It will of course be understood that the present invention has been described above only by way of example and that modifications of details can be made within the scope of the invention.

What is claimed is:

1. A method for modifying a surface of a printing plate, the method comprising:

providing a printing plate with hardened ink in an ink loving area;

identifying a location of a pixel of an image at the surface, the hardened ink being or having been disposed at the location of the pixel;

disposing additional ink at the location of the pixel of the image; and irradiating the additional ink at the location of the pixel using a laser imaging system so as to harden the additional ink.

2. The method as recited in claim 1 wherein the identifying the location of the pixel is performed using an optical analysis system on a printed product of the printing plate.

3. The method as recited in claim 1 wherein the identifying the location of the pixel is performed using the laser imaging system.

4. The method as recited in claim 1 wherein the laser imaging system is an on-press laser imaging system useable to establish the image.

5. The method as recited in claim 1 further comprising adding a hardening agent to the additional ink prior to the irradiating, the hardening agent being curable by a frequency of an electromagnetic radiation emitted by the laser imaging system.

6. The method as recited in claim 1 wherein the irradiating the additional ink produces a hardened ink surface useable for printing.

7. The method as recited in claim 6 wherein the hardened ink surface is capable of receiving further additional ink for performing the printing.

8. The method as recited in claim 6 further comprising:

disposing the additional ink at the location after at least one print run so as to establish a renewed hardened ink surface useable for printing.

9. The method as recited in claim 1 wherein the hardened ink is disposed on a primary image surface of the image.

10. The method as recited in claim 9 wherein the primary image surface includes a polymer substance.

11. The method as recited in claim 1 wherein the hardened ink is disposed on a printing substrate of the printing plate.

12. The method as recited in claim 1 further comprising irradiating the hardened ink at the location of the pixel using a laser system so as to loosen at least a portion of the hardened ink for disposing of the additional ink.

13. The method as recited in claim 1 further comprising irradiating the hardened ink at the location of the pixel so as to ablate at least a portion of the ink for disposing of the additional ink.

14. The method as recited in claim 1, further comprising irradiating the hardened ink so as to loosen at least a portion of the hardened ink and treating the hardened ink with a fountain solution so as to remove at least the first portion of the hardened ink.

15. The method as recited in claim 1 wherein the hardened ink is erroneously disposed at the location of the pixel.

16. The method as recited in claim 1 further comprising:

identifying a location of a second pixel of the image at the surface;

disposing second additional ink at the location of the second pixel; and irradiating the second additional ink at the location of the second pixel using the laser imaging system so as to harden the second additional ink.

17. The method as recited in claim 16 further comprising:

identifying a second location of the second pixel of the image at the surface; and irradiating the second additional hardened ink at the second location of the second pixel using a laser system so as to loosen the second additional hardened ink or so as to ablate the second additional hardened ink.

18. The method as recited in claim 1 wherein the irradiating is performed with the printing plate disposed on a cylinder of a printing press.

19. The method as recited in claim 1 further comprising identifying the pixel as a worn pixel of the image.

* * * * *